US007545338B2

(12) United States Patent
McLean

(10) Patent No.: US 7,545,338 B2
(45) Date of Patent: Jun. 9, 2009

(54) LOG-PERIODIC DIPOLE ARRAY (LPDA) ANTENNA AND METHOD OF MAKING

(75) Inventor: James S. McLean, Austin, TX (US)

(73) Assignee: TDK Corporation, Chiba (JP)

( * ) Notice: Subject to any disclaimer, the term of this patent is extended or adjusted under 35 U.S.C. 154(b) by 288 days.

(21) Appl. No.: 11/560,434

(22) Filed: Nov. 16, 2006

(65) Prior Publication Data

US 2008/0117115 A1 May 22, 2008

(51) Int. Cl.
*H01Q 11/10* (2006.01)

(52) U.S. Cl. ..... 343/792.5; 343/810

(58) Field of Classification Search ..... 343/792.5, 343/793, 810

See application file for complete search history.

(56) References Cited

U.S. PATENT DOCUMENTS

| | | | | |
|---|---|---|---|---|
| 5,093,670 | A | 3/1992 | Braathen | |
| 6,094,176 | A | 7/2000 | Van Hoozen et al. | |
| 6,133,889 | A | 10/2000 | Yarsunas et al. | |
| 6,677,912 | B1 | 1/2004 | McLean | |
| 6,734,827 | B2 | 5/2004 | Killen et al. | |
| 6,885,350 | B2 | 4/2005 | Godard et al. | |
| 7,030,829 | B1 | 4/2006 | McLean | |
| 7,042,413 | B2 * | 5/2006 | Mazoki et al. | 343/795 |
| 7,259,725 | B2 * | 8/2007 | Wang et al. | 343/792.5 |
| 2006/0202900 | A1 * | 9/2006 | Simile | 343/792.5 |

FOREIGN PATENT DOCUMENTS

| | | |
|---|---|---|
| GB | 2180401 | 3/1987 |
| WO | 2006/096402 | 9/2006 |

* cited by examiner

*Primary Examiner*—Tan Ho
(74) *Attorney, Agent, or Firm*—Kevin L. Daffer; Daffer McDaniel, LLP

(57) ABSTRACT

A log periodic dipole array (LPDA) antenna including a first antenna element, a second antenna element and a pair of transmission line structures is provided herein. The first antenna element is fabricated as a continuous piece of conductive material to include a plurality of dipole elements extending outward from a center conductor. The second antenna element is fabricated in the same manner, albeit a mirror image, of the first antenna element. In one embodiment, the antenna elements are fabricated by cutting a contour of the plurality of dipole elements and the center conductor from a sheet of metal (e.g., aluminum or one of its alloys). The antenna elements and transmission line structures are preferably coupled, such that no electrical discontinuities exist between the antenna elements and a respective transmission line structure. In one embodiment, a conductive epoxy or a brazing process is used to permanently attach flat bottom surfaces of the transmission line structures to a different center conductor of the first and second antenna elements.

27 Claims, 8 Drawing Sheets

LOG-PERIODIC DIPOLE ARRAY (LPDA) ANTENNA AND METHOD OF MAKING

BACKGROUND OF THE INVENTION

1. Field of the Invention

This invention relates to broadband antenna design and, more particularly, to a log-periodic dipole array (LPDA) antenna with improved performance over a broad frequency range.

2. Description of the Related Art

The following descriptions and examples are given as background only.

Log-periodic dipole array (LPDA) antennas are popular broadband antennas for many applications. In general, an LPDA antenna includes a collection of linear or tapered dipoles, which are scaled and arranged in a log-periodic array. Each dipole within the array comprises two elements or halves, which vary in length and extend outward from a pair of transmission line structures (i.e., "feed conductors"). The dipoles are arranged from shortest to longest, such that the length and spacing between dipole elements varies logarithmically along the antenna. In addition, the dipole lengths and spacings are related to the frequency range over which the antenna is configured to operate. For example, the length of the longest dipole is proportional to the lowest operating frequency, while the length of the shortest dipole is proportional to the highest operating frequency of the LPDA antenna. In order to provide a relatively broad frequency range, a relatively large LPDA antenna having a great discrepancy between the lengths of the longest and shortest elements is typically needed.

In many cases, the dipoles are constructed from aluminum bar stock having a cylindrical cross-section. However, other conductive materials (such as copper and its alloys) and cross-sections (such as rectangular) may also be used to fabricate the dipole elements. In most cases, the dipole elements are attached to the feed conductors using screws or other mechanical fasteners. As an alternative, the dipole elements may be individually soldered or welded to the feed conductors. However, soldering and welding are seldom used, because the intense localized heating required by these processes tends to distort the antenna structure.

During use, the LPDA is oriented such that the end with the shortest elements (i.e., the front end) is pointed in the desired direction of transmission or reception. In most cases, the antenna is fed at the front end to avoid pattern distortions. For example, the feed conductors are usually spaced apart and arranged in a plane perpendicular to the dipole elements. In some cases, the antenna may be fed by running a coaxial feed line along the interior of one of the feed conductors to which the dipole elements are connected. Such a configuration is typically referred to as an "over/under feed mechanism."

Bringing the feed signal to the front of the antenna serves two purposes. First, it allows the connector to the signal source or receiver to be realized at the back end of the antenna (i.e., the end with the longest elements), which provides a significant mechanical advantage. Second, feeding the antenna at the front reduces pattern distortions and provides an intrinsic balancing network. For example, the coaxial feed line may be fully contained inside one of the two feed conductors of the over/under feed mechanism. At the front of the antenna (i.e., the "feed region"), the inner conductor of the coaxial feed line may protrude from one conductor and connect to the other conductor. If the feed region is electrically small, current continuity will be maintained and the currents flowing along the two conductors will be balanced.

The above feed arrangement is often referred to as an "infinite balun." Although not technically a balun, the feed arrangement provides an intrinsic current balance for the antenna, thereby eliminating the need for an additional balancing transformer. By feeding the antenna at the front end (i.e., at the smaller, high frequency elements), no blockage occurs and the antenna provides a unidirectional pattern that is maintained over a broad frequency range.

In order to direct the antenna's radiation "forward" even though it is being fed "backwards," successive dipole elements must be fed by signals 180° out of phase. This is achieved by electrically connecting each feed conductor to alternating halves of the successive dipoles. For example, a feed conductor may be electrically connected to the "left" element of one dipole pair, followed by the "right" element of the next dipole pair, and so on.

The most successful LPDA designs available today combine the "infinite balan" technique with the over/under feed mechanism discussed above. However, traditional LPDA designs incorporating these techniques still present many disadvantages. For example, conventional LPDA antennas that use screws (or other mechanical fasteners) to attach the dipole elements to the feed conductors often suffer from intermittent electrical contact at the base of the elements (i.e., at the connection points between the dipole elements and the feed conductors). In other words, thermal expansion of the dipole elements cause the fasteners to loosen over time, allowing moisture and oxygen in between the base of the elements and the feed conductors. This leads to unavoidable oxidation and intermittent electrical contact at the base of the elements. In some cases, the electrical contact problem may be solved by soldering or welding the dipole elements directly to the feed conductors, as noted above. However, soldering and welding require intense localized heating, which tends to distort the antenna structure. For this reason, mechanical fasteners (such as screws) are almost primarily used to attach the dipole elements to the feed conductors.

In addition, LPDA designs employing dipole elements attached with mechanical fasteners become impractical at high operating frequencies (e.g., at about microwave frequencies and above). As noted above, the lengths of the dipole elements become increasingly shorter as the high frequency limit of the operating frequency range increases. In most cases, the cost associated with each dipole element is similar, regardless of element size, because the same machining processes are involved in the manufacture of each element. Thus, it becomes very expensive to extend the high frequency limit of a traditional LPDA antenna into the microwave frequency range. In addition, the over/under feed mechanism necessarily staggers the two halves of each dipole to accommodate higher frequency limits. However, staggering introduces cross-polarized radiated fields, which can only be minimized by reducing the size of the feed geometry. This often results in power handling problems and increases the difficulty of assembly.

One approach to fabricating an LPDA antenna with an increased high frequency limit is to implement the antenna on a printed circuit board (PCB). For example, U.S. Pat. No. 5,903,670 to Braathen provides an LPDA antenna in which the dipole elements and one feed conductor are patterned onto one side of an insulating substrate, while a second feed conductor is patterned onto an opposite side of the substrate. The feed conductors are implemented as micro-strip lines, which may be embedded within the substrate or coupled to top and bottom surfaces of the substrate. Phase transposition is provided by connecting the second feed conductor to alternating dipole elements through vias formed within the substrate. In this manner, the dielectric substrate supports the dipole elements and keeps them in the desired co-planar configuration, while the vias connect the second feed conductor to the dipole elements at various points.

Even though LPDA antennas built using printed circuit technology enable high frequency operation, they provide their own set of disadvantages. For example, the dielectric substrate of any printed circuit necessarily perturbs the electromagnetic field generated by the antenna, even if it is of low permittivity. Perhaps the best available substrates (e.g., PTFE based substrates) exhibit a relative permittivity of about 2.0. Even these substrates cause a significant perturbation of the electromagnetic field, which ultimately degrades the intended radiation pattern.

In addition, printed circuit antennas are typically limited to operating over a narrow, high frequency range and not readily or inexpensively adapted for operating over relatively larger frequency ranges. Attempts have been made to combine smaller, printed circuit LPDA antennas with larger, traditionally-fabricated LPDA antennas to cover relatively large frequency ranges. However, the marriage of two dissimilar LPDAs (i.e., the presence of dielectric in the printed circuit based LPDA and the absence of dielectric in the traditional LPDA necessarily makes them dissimilar) inevitably results in some performance degradation, especially in the crossover region (i.e., the region arranged about the upper frequency limit of the traditional LPDA and the lower frequency limit of the printed circuit LPDA). The presence of a dielectric substrate also tends to degrade the frequency independent nature of the LPDA antenna.

Therefore, a need remains for an improved LPDA antenna design. In particular, the improved LPDA design would overcome the above-mentioned problems associated with both traditional and printed circuit LPDA designs.

SUMMARY OF THE INVENTION

The following description of various embodiments of log-periodic dipole array (LPDA) antennas and methods is not to be construed in any way as limiting the subject matter of the appended claims.

According to one embodiment, a log periodic dipole array (LPDA) antenna is provided herein, along with a method for making such an antenna. In general, the LPDA antenna may include a pair of antenna elements coupled to a pair of transmission line structures. For example, a first antenna element may be fabricated as a continuous piece of conductive material to include a plurality of dipole elements (i.e., dipole halves) extending outward from a center conductor in a log-periodic fashion. A second antenna element may be fabricated in the same manner, albeit a mirror image, of the first antenna element. In most cases, the conductive material may be selected from a group of metals including, but not limited to, aluminum, copper, magnesium and alloys thereof. In some cases, aluminum may be preferred over other metals, due to its low weight and cost. However, other low-density metals and metal alloys may be used, in other cases.

In some cases, each of the first and second antenna elements may be fabricated from a sheet (or plate) of metal having a uniform thickness. For example, each of the antenna elements may be fabricated by cutting a contour of the plurality of dipole elements and the center conductor from the sheet (or plate) of metal. In most cases, the contour may be cut from the sheet (or plate) of metal using a high pressure water jet tool, a high pressure abrasive jet tool, a laser cutting tool, a plasma cutting tool or a machining tool. However, fabrication of the antenna elements is not limited to a cutting process, and may be performed differently (e.g., by casting or molding), in other cases. Regardless of the particular process used, the antenna elements may be fabricated without printing or patterning the dipole elements on or within a dielectric substrate.

In most cases, the transmission line structures may be fabricated such that each comprises a conductive member having a flat bottom surface. Various fabrication methods may be used to form the conductive members. For example, the conductive members may each be fabricated from a metal or metal alloy using an extrusion, casting, molding or machining process. At least one of the transmission line structures may be formed to include a cable guide or opening. For example, a cable guide or opening may be formed within at least one of the conductive members, such that it extends along an entire length of the conductive member. This may allow an insulated wire or cable (e.g., a coaxial cable) to be threaded through the cable guide or opening for feeding the LPDA antenna.

In general, the antenna elements may be coupled to the transmission line structures, such that no electrical (or thermal) discontinuities exist between the antenna elements and their respective transmission line structure. In particular, the antenna elements may be coupled to the pair of transmission line structures by permanently attaching the flat bottom surface of each conductive member to a respective center conductor of the first and second antenna elements. In one embodiment, the flat bottom surfaces of the conductive members may be permanently attached to the center conductors of the antenna elements using a brazing process. In another embodiment, the flat bottom surfaces of the conductive members may be permanently attached to the center conductors of the antenna elements using a conductive epoxy. Such processes may ensure that a continuous electrical and thermal connection exists between the flat bottom surfaces and the center conductors along an entire length of the center conductors.

In some cases, one or more holes may be formed within the flat bottom surfaces of the conductive members and through the center conductors of the antenna elements. In such cases, the holes formed within the flat bottom surfaces may be aligned with the holes formed within the center conductors, so that fixturing pins may be inserted to ensure precise assembly of the antenna elements to their respective transmission line structure. However, fixturing pins and alignment holes may not be necessary in all embodiments of the invention.

According to another embodiment, a log periodic dipole array (LPDA) antenna comprising a high frequency portion and a low frequency portion (i.e., a hybrid LPDA) is provided herein. In general, the high frequency portion may include a pair of antenna elements and a first pair of transmission line structures, as described above. In other words, the antenna elements may each be fabricated as a continuous piece of conductive material to include a first plurality of dipole elements extending outward from a center conductor in a log-periodic fashion. Each of the transmission line structures may be permanently affixed to a different center conductor of the antenna elements, such that no electrical or thermal discontinuities exist between the antenna elements and their respective transmission line structure along an entire length of the center conductors. In one embodiment, a brazing process may be used to permanently attach the flat bottom surfaces of the conductive members within the first pair of transmission line structures to the center conductors of the antenna elements. In another embodiment, a conductive epoxy may be used to permanently attach the flat bottom surfaces to the center conductors. In some cases, the high frequency portion may be configured for operating within a relatively high frequency range of about 300 MHz to about 6000 MHz. However, one skilled in the art would recognize how the high frequency portion could be modified for operating within a substantially different range.

The low frequency portion may generally include a second plurality of dipole elements extending outward from a second pair of transmission line structures in a log-periodic fashion. For example, the low frequency portion may be fabricated in a conventional manner by attaching individual dipole elements to the second pair of transmission line structures with mechanical fasteners (e.g., screws). In one embodiment, the low frequency portion may be configured for operating within a relatively low frequency range of about 80 MHz to about 300 MHz. However, one skilled in the art would recognize how the low frequency portion could be modified for operating within a substantially different range.

The hybrid LPDA antenna may be realized by connecting the high frequency portion to the low frequency portion. In most cases, the high frequency portion may be connected to the low frequency portion by fabricating the first and second pairs of transmission line structures as one complete pair of transmission line structures. For example, an antenna element may be brazed to a flat bottom surface of a conductive member near a front end of the transmission line structure, while conventional dipole elements are attached to side surfaces of the conductive member near a back end of the same transmission line structure. Because the antenna elements are formed without a dielectric substrate, the high frequency portion can be connected to the low frequency portion without disturbing a radiation pattern of the hybrid LPDA antenna.

BRIEF DESCRIPTION OF THE DRAWINGS

Other objects and advantages of the invention will become apparent upon reading the following detailed description and upon reference to the accompanying drawings in which.

Figure 1:
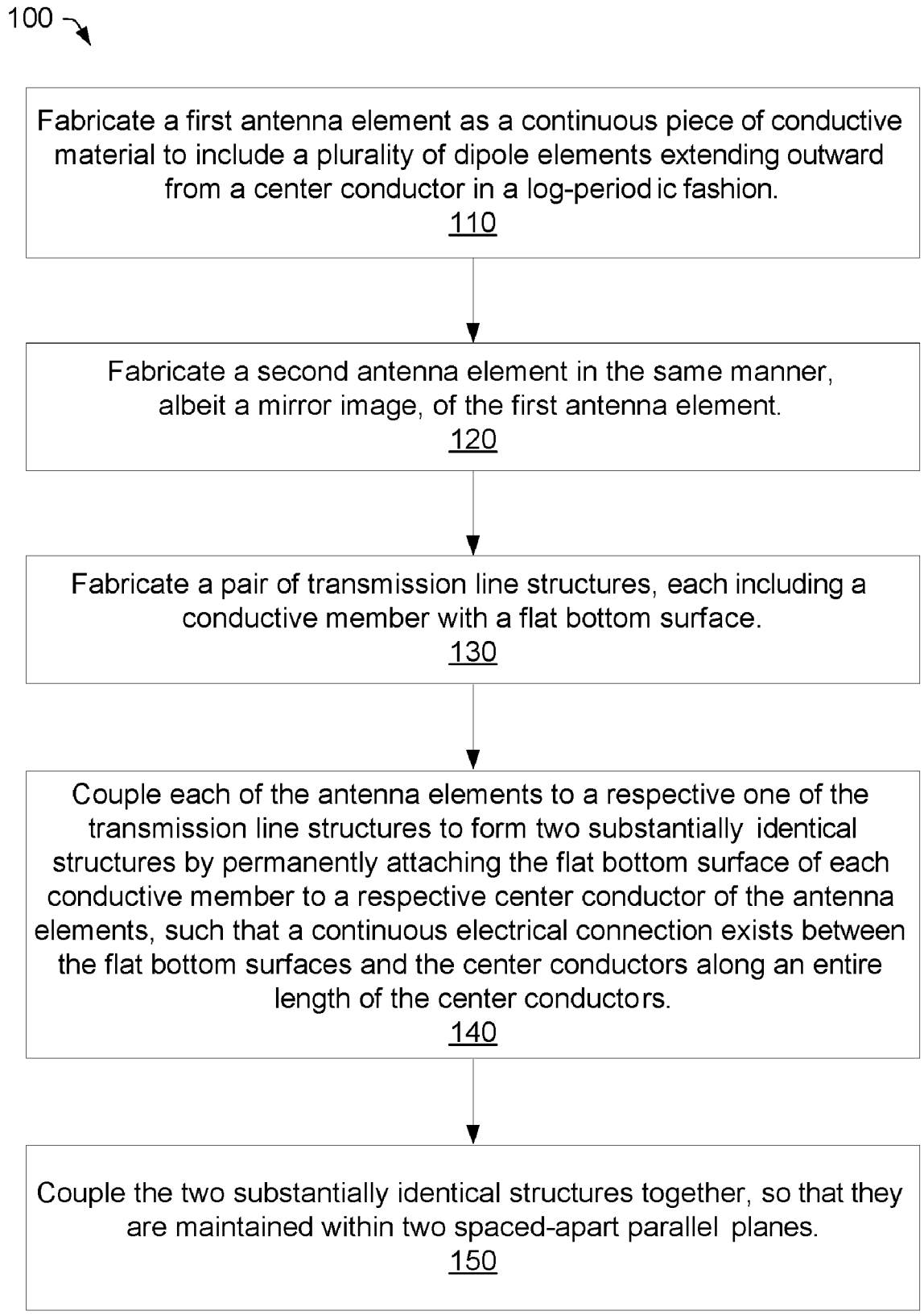
FIG. 1 is a flow chart diagram illustrating a method for making a log-periodic dipole array (LPDA) antenna in accordance with one embodiment of the invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Turning now to the drawings, FIGS. 1-11 illustrate various embodiments of an improved LPDA antenna and method of making. As described in more detail below, the improved LPDA antenna overcomes numerous problems associated with both traditional and printed circuit LPDA designs. For example, the improved LPDA antenna provides a high frequency alternative to both traditional and printed circuit LPDA designs. Second, the improved LPDA antenna improves upon traditional LPDA designs by eliminating the electrical contact problem associated with thermal expansion/oxidation of the mechanical fasteners used to connect the dipole elements to the feed conductors. Third, the improved LPDA antenna improves upon printed circuit LPDA designs by eliminating the pattern disturbances associated with a dielectric substrate. Other improvements/advantages may become apparent in light of the description below.

FIG. 1 illustrates an improved method (100) for making a log periodic dipole array (LPDA) antenna, in accordance with one embodiment of the invention. In some cases, the method may begin by fabricating a pair of antenna elements, each including a plurality of dipole elements extending outward from a center conductor in a log-periodic fashion. As used herein, the term "dipole element" is used to describe one half of a dipole. As described in more detail below, a first antenna element may be fabricated as a continuous piece of conductive material (in step 110) by cutting a contour of the dipole elements and the center conductor from a sheet (or plate) of conductive material. A second antenna element may then be fabricated in a similar manner, albeit a mirror image, of the first antenna element (in step 120). Although steps 110 and 120 are performed consecutively in the embodiment of FIG. 1, they may be performed simultaneously in other embodiments of the invention. Exemplary embodiments of the pair of antenna elements will be described in more detail below in reference to FIGS. 2 and 8.

As used herein, the term "conductive" generally refers to electrical conductivity, although "conductive" materials may also be described as being thermally conductive. In one embodiment, the pair of antenna elements may be cut from one or more sheets (or plates) of aluminum or aluminum alloy. As described in more detail below, suitable aluminum alloys may include, but are not limited to, 2000 series to 7000 series aluminum alloys. However, other conductive materials such as magnesium, copper, brass and various alloys thereof may be suitable in other embodiments of the invention. For example, magnesium is somewhat lighter (i.e., it has a higher strength-to-weight ratio) than aluminum, and thus, might be used to decrease the weight of the subsequently formed antenna. In general, substantially any solid conductive material having a relatively low density may be used to fabricate the pair of antenna elements. For example, a lower density conductor may be desirable for minimizing the weight of the subsequently formed antenna.

In most cases, the pair of antenna elements may be cut from a sheet (or plate) of conductive material having a uniform thickness. A suitable range of thicknesses may include, but are not limited to, about 1 mm to about 8 mm. In general, the thickness of the conductive material should be chosen to maintain the diameter-to-length ratio within some reasonable range. For example, the thickness of the conductive material is somewhat arbitrary. However, it is generally desirable to use larger thicknesses (e.g., ⅛ inch or larger) in order to provide antenna elements with greater effective diameters. In addition to increased mechanical stability, these elements have lower radiation Q, and hence, are broader band than antenna elements with smaller effective diameters. In other cases, the pair of antenna elements may be cut from two or more sheets of conductive material having different thicknesses. As described in more detail below, the different sheet thicknesses may be used to approximate an idealized antenna, in which the diameter-to-length ratio for each dipole element is roughly the same.

In one embodiment, the pair of antenna elements may be cut from a sheet (or plate) of conductive material using a high-pressure water jet or high-pressure abrasive jet process. A high-pressure water jet process is considered particularly useful in providing inexpensive fabrication of highly detailed parts. However, the fabrication process is not so limited, and may include other processes such as those involving high-intensity laser (e.g., $CO_2$) cutting tools, plasma cutting tools and conventional machining, among others. The optimum process depends to some extent on the thickness of the sheet (or plate) and the level of detail required to fabricate the antenna elements. As an alternative to cutting, the antenna elements may be fabricated using a casting or molding process.

In some cases, the method may continue by fabricating a pair of transmission line structures, each including a conductive member with a flat bottom surface (in step 130). Although illustrated as occurring after steps 110 and 120, step 130 may be performed prior to or during steps 110 and 120 in other embodiments of the invention. The order in which the antenna elements and transmission line structures are fabricated is not necessarily important, and thus, may be performed as desired. In general, the conductive members may be fabricated from a metal or metal alloy using an extrusion, casting, drawing, molding or machining process. Although the conductive members are typically fabricated using the same conductive material selected for the antenna elements, a substantially different conductive material may be used in alternative embodiments of the invention.

In general, at least one of the transmission line structures will include a cable guide or opening formed within a respective one of the conductive members. As described in more detail below, the cable guide or opening may be formed, such that it extends along a length of the conductive member and allows an insulated wire or cable to be threaded there through for feeding the LPDA antenna at the front end. In some cases, the cable guide or opening may be included within each transmission line structure to simplify the fabrication of the conductive members and/or reduce the weight of the subsequently formed antenna. In other cases, the cable guide or opening may be included within only one transmission line structure. Exemplary embodiments of the transmission line structures will be described in more detail below in reference to FIGS. 4 and 5.

Once the antenna elements and transmission line structures are formed, the method may continue by coupling each of the antenna elements to a respective one of the transmission line structures to form two substantially identical structures (in step 140). One embodiment of the two substantially identical structures is illustrated in FIG. 6 and described in more detail below. In general, the antenna elements may be coupled to the transmission line structures by permanently attaching the flat bottom surfaces of each conductive member to a respective center conductor of the antenna elements, such that a continuous electrical and thermal connection exists between the flat bottom surfaces and the center conductors along an entire length of the center conductors. This provides a large contact surface area, which provides both mechanical and electrical advantages.

In one embodiment, the flat bottom surfaces of the conductive members are permanently attached to the center conductors of the antenna elements using a brazing process. Generally speaking, brazing is a method of joining two pieces of metal together with a third, molten filler metal. To begin the brazing process, the joint area is heated above the melting point of the filler metal, but below the melting point of the metal pieces being joined. After heating, the molten filler metal flows into the gap between the two metal pieces by capillary action and forms a strong metallurgical bond as it cools.

In some embodiments, the heat required for brazing may be provided by a hand-held torch, a furnace or an induction heating system. Although torch brazing is relatively cost effective, the quality of the joint is largely dependent on operator skill and consistency is sometimes an issue. Therefore, torch brazing may be preferred only in low-volume applications when highly skilled operators are available. Furnace brazing, on the other hand, does not require a skilled operator and may be used to braze many assemblies at once. However, the method is only practical if the filler metal can be pre-positioned within the joints to automate the brazing process. In addition, because furnaces are normally left on to eliminate long start up and cool down delays, such brazing methods are not particularly energy efficient.

Brazing by induction heat has the advantages of speed, accuracy and consistency. In a well-designed induction system, each part is identically positioned in an induction coil and the filler material is carefully regulated. This type of system consistently and quickly delivers a precise amount of heat to a small area. The induction heating power supply's internal timer can be used to control cycle time, and temperature control feedback for each individual part can be provided with thermocouples, IR thermometers or visual temperature sensors. Induction furnaces are also available for high volume brazing.

In some embodiments, other techniques such as dip brazing and resistance brazing may be preferred. For example, resistance brazing is effective for joining relatively small, highly conductive metal parts. Heat is produced by the resistance of the parts to the current. In dip brazing, the antenna parts (i.e., antenna element and transmission line structure) are dipped or immersed in a molten salt bath after the parts are chemically cleaned to remove surface oxides. Prior to dipping, the antenna parts are assembled with the filler metal preplaced within the joints (or as near to the joints as possible). The assembly is then preheated in an air furnace to a temperature above approximately 550° C. to insure uniform temperature. After preheating, the assembly is immersed in a molten salt bath having a temperature of approximately 600° C. As the assembly is immersed or dipped, the molten salt comes in contact with all surfaces simultaneously to provide extremely fast and uniform heating. Since the molten salt acts as a flux, complete bonding on oxide-free surfaces assures high quality joints. Although the immersion time is determined by the mass to be heated, it is seldom over two minutes in duration. For these reasons, dip brazing may be considered a preferred method for joining the antenna elements to their respective transmission line structures, in at least one embodiment of the invention.

In some embodiments, soldering or welding may be used in place of brazing to join the antenna elements to their respective transmission line structures. Although brazing, soldering and welding are similar in many respects, there are important differences. For example, soldering can be done at significantly lower temperatures (e.g., below 450° C.) than welding or brazing. However, soldering may not produce as strong of a joint as welding and brazing. Welding, on the other hand, is a higher-temperature process (e.g., above 658° C. for pure aluminum) in which the two metals to be joined are actually melted and fused together. Welded and brazed joints are usually nearly as strong as the metals being joined. However, because of its high temperature requirements, welding works best with relatively strong, thick parts that can withstand the heat. In most cases, the intense localized heating required in welding may cause the relatively thin antenna elements to warp or distort. In addition, welding and soldering are usually ideal for applications which benefit from highly localized, pinpoint heating. However, welding and soldering are more difficult to apply to linear joints (such as those between the antenna elements and transmission line structures), not as easy to automate, and not easily adaptable for joining metals with different melting points.

Therefore, brazing may be the preferred method for joining the antenna elements and transmission line structures in at least one embodiment of the invention. For example, brazing works at substantially lower temperatures (e.g., below the 658° C. melting point for pure aluminum). Therefore, brazing may be more appropriate for joining the relatively thin antenna elements to the transmission line structures because metal warpage and distortion can be minimized. In addition, linear joints (such as those formed between the antenna elements and the flat bottom surfaces of the transmission line structures) are substantially easier to braze because the filler metal naturally flows into the joint area. Furthermore, even though both brazing and welding work well for joining metals with similar melting points, it is generally easier to join dissimilar metals with brazing. Moreover, brazing tends to be a more flexible process. While welding is difficult to automate partially or in stages, pre-fluxing and pre-positioning stations can be set up in the brazing process to increase speed for high throughput requirements.

Therefore, of all the heated methods available for metal joining, brazing may be the most versatile. Brazed joints also have great tensile strength and are often stronger than the two metals being bonded together. In addition, brazed joints repel gas and liquid, withstand vibration and shock and are unaffected by normal fluctuations in temperature. Because the metals to be joined are not themselves melted, they retain their original metallurgical characteristics and are not warped or distorted.

As an alternative to the heat methods described above, a conductive adhesive or epoxy may be used, in other embodiments of the invention, to attach the antenna elements to their respective transmission line structure. Suitable conductive epoxies may include, but are not limited to, silver filled epoxies. Such epoxies may provide very good electrical and thermal contact between the antenna elements and transmission line structures. In addition, a conductive epoxy may provide a very strong mechanical bond between the antenna elements and transmission line structures, due to the relatively large contact area there between. In some cases, the contact surfaces of the antenna elements and transmission line structures may be treated prior to application of the conductive epoxy. In one example, the contact surfaces may be chemically or mechanically etched to increase the surface roughness of the parts.

In some cases, means may be provided for coupling the antenna elements to their respective transmission line structure, such that they are precisely aligned. For example, one or more holes may be formed within the flat bottom surfaces of the transmission line structures. These holes may be aligned with one or more holes formed through the center conductors of the antenna elements. In one embodiment, the holes may be formed using a water/abrasive jet cutting, laser cutting, plasma cutting or machining process. In some cases, the process selected to form the holes may be similar to the process used to form the antenna elements. In other cases, a different process may be selected to form the holes. As described in more detail in reference to FIG. 6B, the antenna elements may be precisely aligned to their respective transmission line structure by inserting fixturing pins within the alignment holes. The fixturing pins are inserted before the antenna elements are permanently affixed to their respective transmission line structure, so that the pins may hold the parts in place during the attachment process. In addition to ensuring precise alignment, the fixturing pins may provide an additional amount of mechanical stability to the two substantially identical structures. However, one skilled in the art would understand how alternative means may be used to provide precision alignment between the antenna elements and transmission line structures.

Figure 7A:
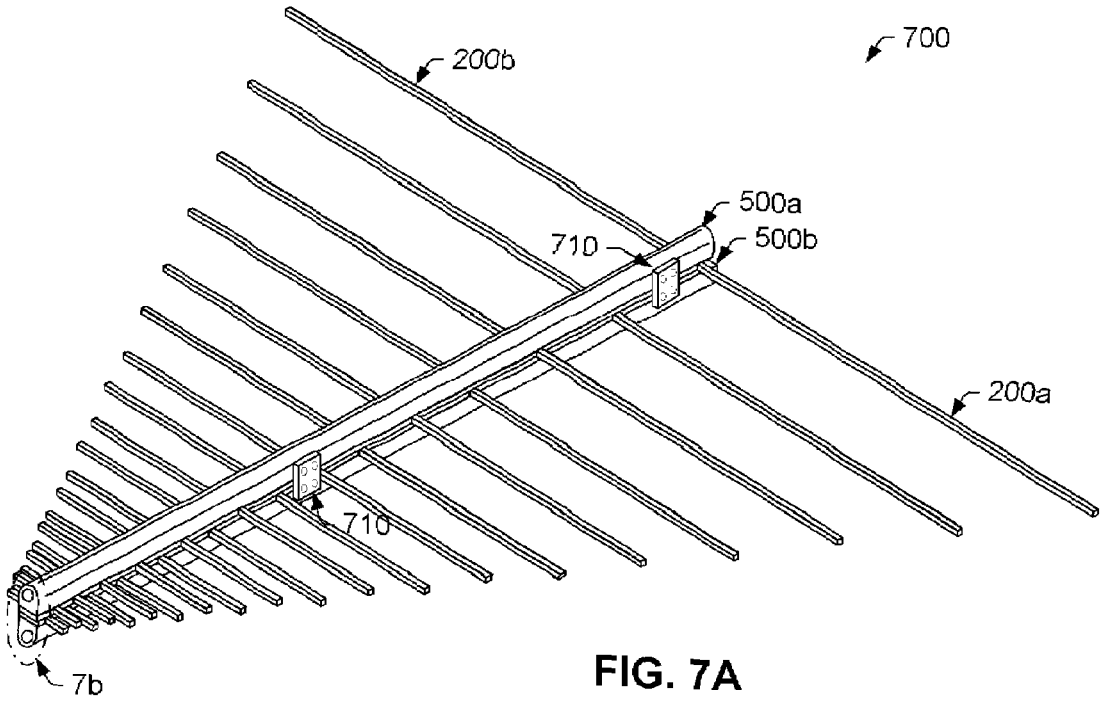
FIG. 7A is a perspective view of a complete LPDA antenna, according to one embodiment of the invention.
Figure 7B:
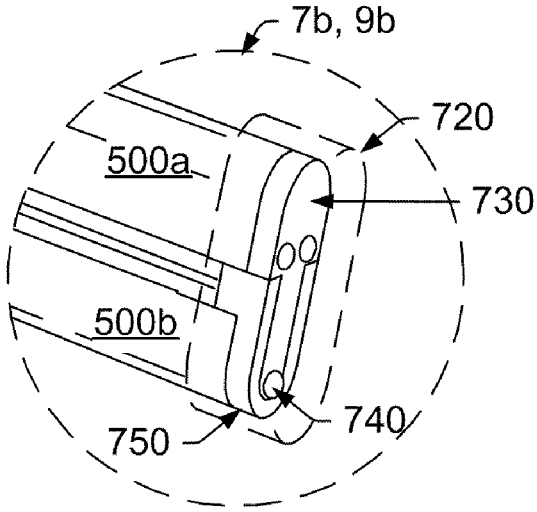
FIG. 7B is a perspective view, within region 7*b* of FIG. 7A and region 9*b* of FIG. 9, of the front end of the LPDA antenna.
Figure 9:
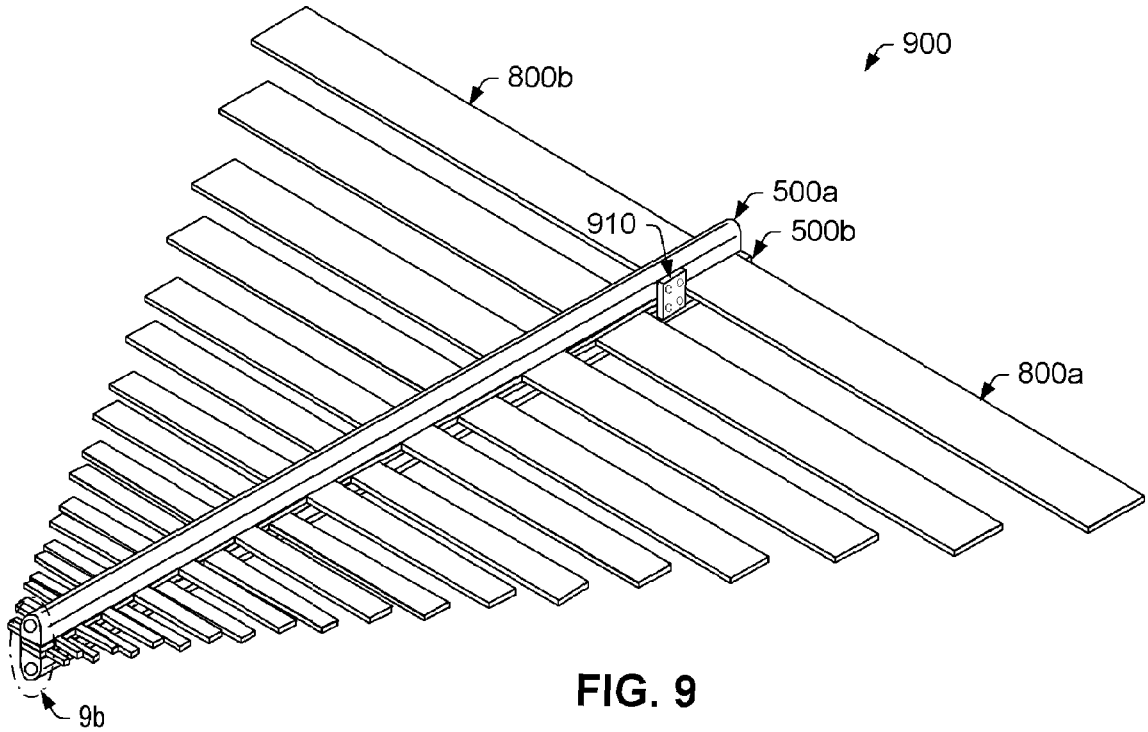
FIG. 9 is a perspective view of a complete LPDA antenna, according to an alternative embodiment of the invention.

Once the antenna elements are attached to their respective transmission line structures, the two substantially identical structures may be coupled together, so that they are maintained within two spaced-apart, parallel planes (in step 150). In one embodiment, the two substantially identical structures may be coupled together by one or more dielectric spacers, as shown in FIGS. 7A, 7B and 9. However, one skilled in the art would understand how other means may be used for supporting the structures, in other embodiments of the invention. Regardless of the particular means used, the spacing between the transmission line structures should be minimized to reduce cross-polarization and pattern distortion, while maintaining appropriate impedance characteristics of the feed transmission line.

One embodiment of an improved method for fabricating an LPDA antenna has now been described. As indicated above, the method improves upon conventional fabrication methods by fabricating each of the antenna elements as a continuous piece of conductive material. For example, the antenna elements may be cut (using, e.g., a high-pressure water jet process) from one or more sheets or plates of conductive material (e.g., aluminum, or one of its alloys). Such a method improves upon printed circuit board LPDA designs by eliminating the pattern distortions created by printing the antenna elements onto a dielectric substrate. In addition, the fabrication method disclosed herein improves upon traditional LPDA designs by permanently attaching the antenna elements to their respective transmission line structures, such that no electrical or thermal discontinuities exist there between. In one preferred embodiment, the antenna elements are brazed onto their respective transmission line structures. In another preferred embodiment, a conductive epoxy is used to attach the antenna elements and transmission line structures. Either means of attachment may be used to form a continuous bond between opposing surfaces of the antenna elements and transmission line structures. This avoids the thermal expansion/oxidation problem that often occurs when individual dipole elements are attached to a transmission line structure with mechanical fasteners (such as screws). By fabricating the antenna elements as a continuous piece of conductive material, the current fabrication method also provides a low cost solution for extending the high frequency limit of the LPDA antenna.

In addition to the method disclosed herein, various embodiments of an improved LPDA antenna are shown in FIGS. 2-11. As noted above, the pair of antenna elements may be fabricated as a continuous piece of conductive material by cutting a contour of the antenna elements, including dipole elements and center conductors, from a sheet (or plate) of the conductive material. In one embodiment, the antenna elements may be cut from a sheet or plate of aluminum, the designation between which depends on the material thickness selected. However, other conductive materials such as copper, magnesium and other low-density metals and metal alloys may be used to fabricate the antenna elements in other embodiments of the invention. As noted above, a low-density metal with good electrical characteristics may be chosen to minimize the weight of the subsequently formed antenna.

In one preferred embodiment, the antenna elements may be fabricated from substantially any aluminum alloy (such as, e.g., 2000 series to 7000 series aluminum alloys). 6000 series aluminum is most common because it is weldable and heat-treatable. In some cases, a 7000 series aluminum alloy may be used to provide the most resistance to bending. Such alloys are typically never used in conventional LPDA designs where the dipole elements are attached with screws. For example, 7000 series aluminum is notorious for its susceptibility to oxidation, and thus, is seldom used in electrical applications. However, once the antenna elements are brazed to their respective transmission line structure, the electrical connection is ensured and the entire surface can be treated. In one example, the surface of the assembly could be chemically treated, possibly with an anodizing or chromate salt process, to provide a highly robust surface with a reduced (or eliminated) susceptibility to oxidation.

By cutting a contour of the antenna elements from a sheet (or plate) of conductive material, the dipole elements and center conductors may have a substantially square or rectangular cross-section. In most cases, the antenna elements may be cut from a single sheet of metal having a uniform thickness, although multiple sheets of metal having different thicknesses may be used in other cases. Different sheet metal thicknesses may be used in embodiments, which attempt to emulate an idealized antenna by maintaining a constant diameter-to-length ratio for each dipole element.

Figure 2:
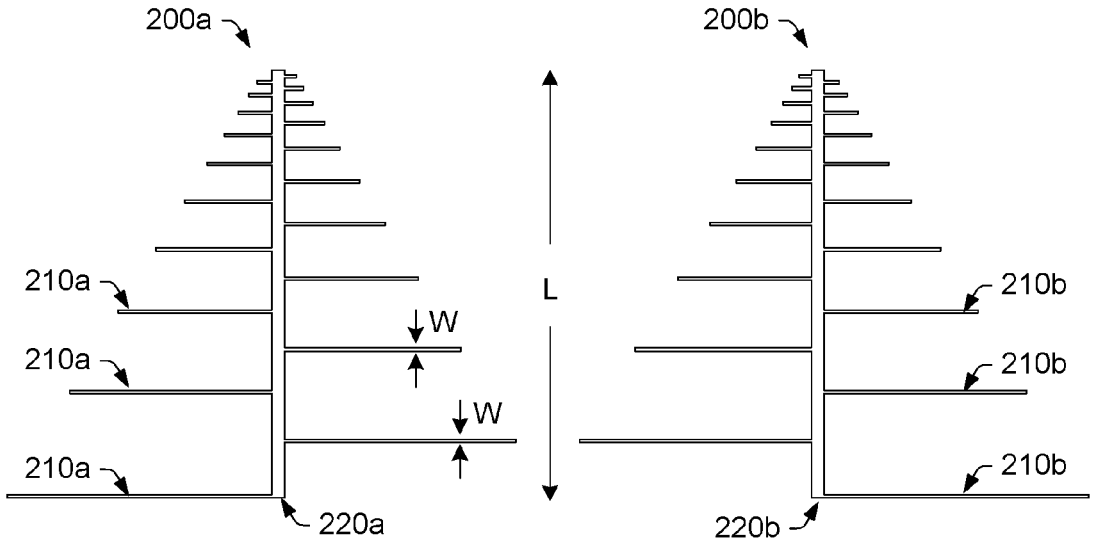
FIG. 2 is a two-dimensional rendition of a pair of antenna elements, according to one embodiment of the invention.
Figure 8:
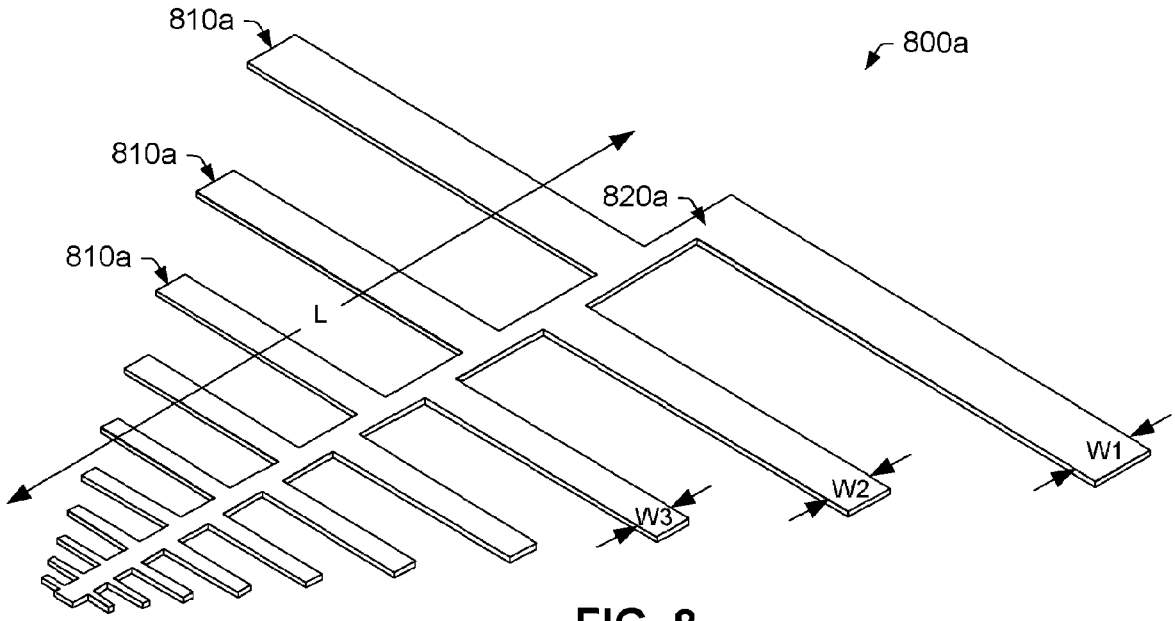
FIG. 8 is a perspective view of an antenna element, according to an alternative embodiment of the invention.

FIG. 2 illustrates a two-dimensional top-side view of antenna elements 200*a* and 200*b*, according to one embodiment of the invention. As shown in FIG. 2, each of the antenna elements includes a plurality of dipole elements (210), which extend outward from a center conductor (220) in a log-periodic fashion. In other words, the dipole elements are logarithmically spaced along a length (L) of the center conductor (220). Although substantially identical, antenna element 200*b* is fabricated as a mirror image of antenna element 200*a*. In the embodiment of FIG. 2, the width (W) of the dipole elements is held constant along the length (L) of the center conductor (220). If the width is held constant, the length-to-diameter ratio may slightly increase, thereby decreasing the radiation Q of the subsequently formed antenna. To avoid such an increase, the width of the dipole elements may alternatively be scaled along the length of the conductor. One embodiment of an antenna element with scaled dipole element widths is shown in FIGS. 8-9 and discussed in more detail below.

Figure 3:
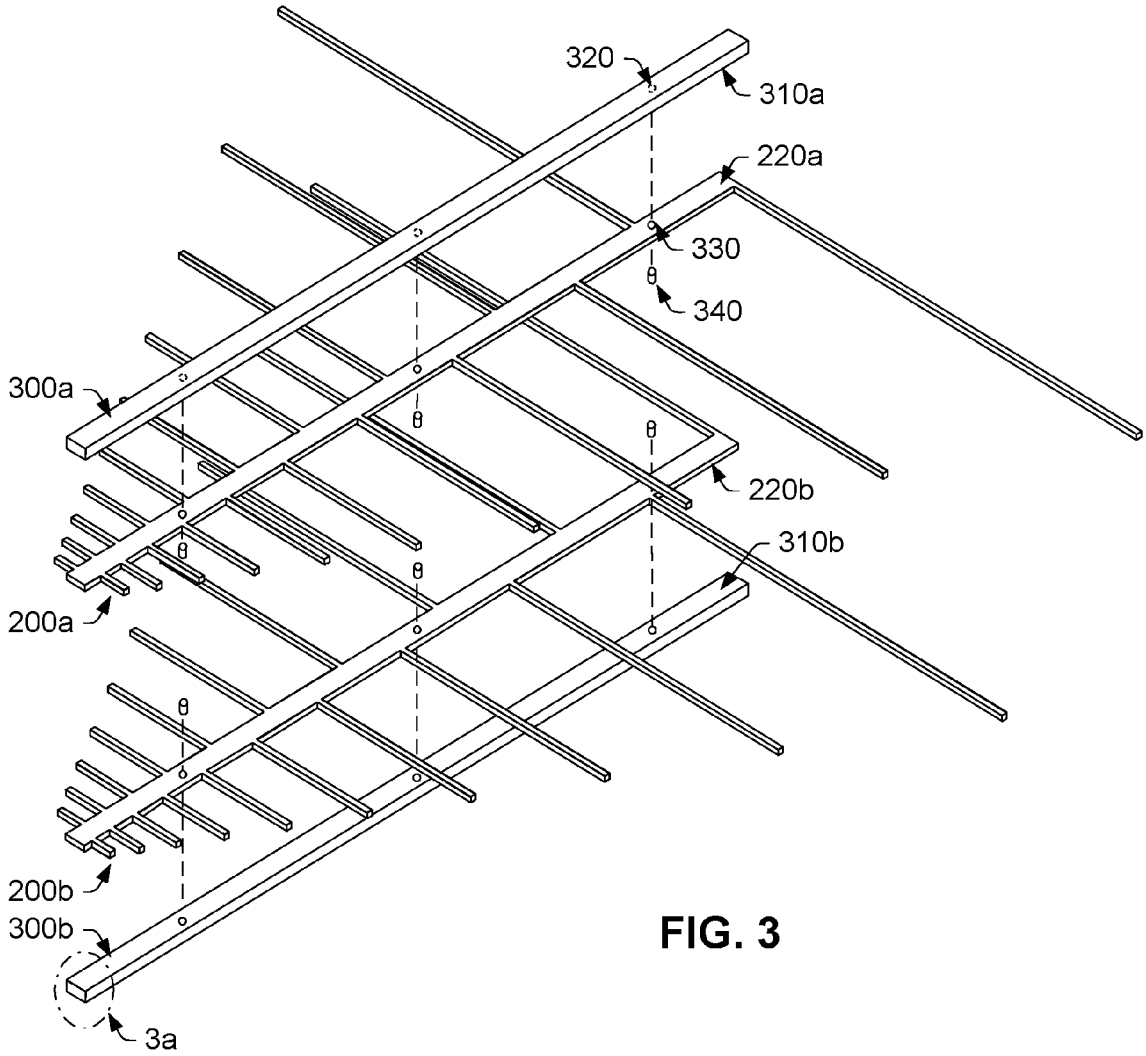
FIG. 3 is a perspective exploded view of an LPDA antenna including a pair of transmission line structures and a pair of antenna elements, as illustrated in FIG. 2.

FIG. 3 is an exploded view illustrating a pair of antenna elements (200*a* and 200*b*) arranged between a pair of transmission line structures (300*a* and 300*b*). As indicated above, each of the antenna elements may be permanently attached to a respective one of the transmission line structures. In a preferred embodiment, the flat bottom surfaces (310*a* and 310*b*) of the transmission line structures (300*a* and 300*b*) may be brazed or epoxied to a respective one of the center conductors (220*a* and 220*b*) to form a continuous bond (and thus, a continuous electrical connection) between the transmission line structures and the antenna elements. In FIG. 3, the transmission line structures (300*a* and 300*b*) are illustrated as having a substantially rectangular cross-section. Although it may be preferred that transmission line structures 300*a* and 300*b* maintain a flat bottom surface (e.g., to simplify the brazing process and maximize contact area), the overall geometry of the transmission line structures may differ in one or more embodiments of the invention.

Various embodiments of potential transmission line geometries are described in FIGS. 2-6 of U.S. Pat. No. 6,677,912 entitled "Transmission line conductor for log-periodic dipole array." The previous U.S. Patent is assigned to the present inventor and incorporated herein in its entirety. Although any of the transmission line geometries shown in FIGS. 2-6 of U.S. Pat. No. 6,677,912 may be used in the present invention, only two will be described below for the purposes of brevity. A more complete description of potential transmission line geometries may be obtained by referring back to the previous patent. In general, the transmission line geometries presented in U.S. Pat. No. 6,677,912 (and described below) enable the spacing between the transmission line structures to be reduced. This increases the characteristic impedance of a balanced transmission line formed using a pair of conductive members, and reduces the cross-polarization and pattern distortions that result from arranging the transmission line structures and antenna elements in different planes.

Figure 4:
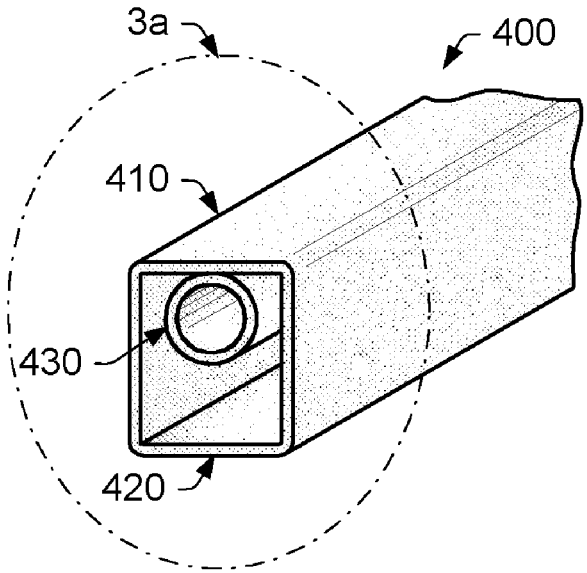
FIG. 4 is a perspective view showing one end of a transmission line structure, according to one embodiment of the invention.

FIG. 4 is a perspective view showing one end (3*a*, FIG. 3) of a transmission line structure, according to one embodiment of the invention. For example, transmission line structure 400 is illustrated as including a conductive member 410 and a cable guide 430. In the embodiment of FIG. 4, conductive member 410 is a conductive tube having a substantially rectangular cross-section and a flat bottom surface 420. Cable guide 430 is another conductive tube having a substantially circular cross-section. In some cases, the outer wall at the top of cable guide 430 may be attached to the inner wall at the top of conductive member 410. However, cable guide 430 may be attached to conductive member 410 in alternative ways not specifically illustrated herein. For example, cable guide 430 may be alternatively attached to the inner sidewalls or bottom surface of conductive member 410. The only constraints placed on cable guide 430 are that the cable guide remains within conductive member 410 and extends along an entire length of the conductive member. This should enable an insulated wire or cable feed line to be threaded from the back to the front of the transmission line structure.

The materials used for and the nature of the connection between conductive member 410 and cable guide 430 may vary, depending on the particular way that the transmission line structure is used. For example, if transmission line structure 400 is to be used as one conductor of a balanced two-conductor transmission line, it is important that there be a shield surrounding the feed line placed within cable guide 430. If cable guide 430 is a conductive tube, formed from similar materials as conductive member 410, then the cable guide itself may function as a shield. In such an embodiment, cable guide 430 must be electrically connected to conductive member 410, so that currents induced within the shield may flow back along an outer surface of the conductive member to produce a balanced line. In some cases, cable guide 430 may be attached to conductive member 410 using a soldering or brazing technique, such that a good (low-resistance) electrical connection is formed between the guide and the conductive member. In some cases, the feed line threaded through conductive cable guide 430 may be a commercially-available coaxial cable, in which the insulation and shield have been removed to simplify the threading process.

In one preferred embodiment, transmission line structure 400 is fabricated from the same conductive material used to form the antenna elements (200*a* and 200*b*). For example, transmission line structure 400 may be fabricated from substantially any aluminum alloy (such as, e.g., 2000 series to 7000 series aluminum alloy). If 7000 series aluminum is used, the surface of the transmission line structure may be chemically treated (after it is brazed or epoxied to a respective antenna element) to avoid oxidation and the problems associated therewith. However, transmission line structure 400 may be fabricated from a substantially different conductive material, in other embodiments of the invention. For example, transmission line structure 400 may be fabricated using copper, magnesium and possibly other low-density metals or metal alloys having good electrical and thermal properties.

As noted in U.S. Pat. No. 6,677,912, cable guide 430 may be formed from a non-conductive material, in other embodiments of the invention. If cable guide 430 is formed from a non-conductive material and conductive member 410 is to be used as part of a balanced transmission line, the feed line to be threaded through cable guide 430 must include its own shield. In some cases, the feed line may be a coaxial cable having its outer insulation and shield left in tact. The shield provided by the feed line would need to be connected to conductive member 410 at each end of the conductive member. In such an embodiment, the electrical conductivity between the cable guide and the conductive member would not be important.

Figure 5A:
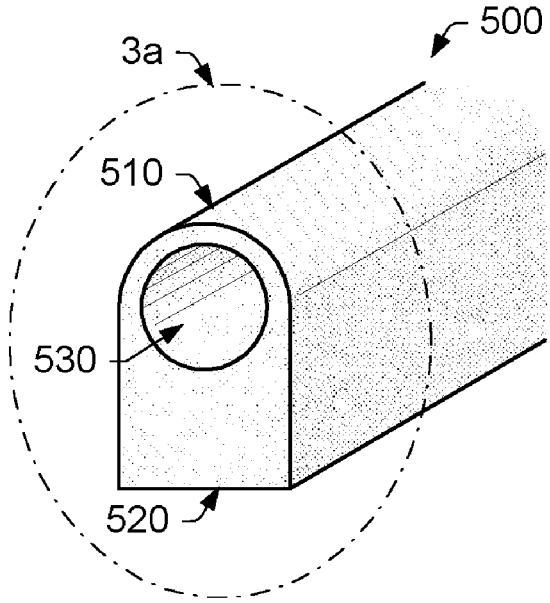
FIG. 5A is a perspective view showing one end of a transmission line structure, according to another embodiment of the invention.

FIG. 5A is a perspective view showing one end (3*a*, FIG. 3) of a transmission line structure, according to another embodiment of the invention. For example, transmission line structure 500 is illustrated as including a conductive member 510 having a flat bottom surface 520 and an opening 530. In most cases, opening 530 may run along an entire length of the conductive member 510, so that the opening may serve as a cable guide. Like cable guide 430, opening 530 is adapted to maintain an insulated wire or cable in a substantially straight orientation, so that the insulated wire or cable may be easily threaded there through.

In one embodiment, conductive member 510 is a conductive bar formed using an extrusion process. For example, conductive member 510 may be formed using extrusion of aluminum. Although aluminum, and particularly 6000 and 7000 series aluminum alloys, is believed to be a desirable conductor material in terms of conductivity and weight, other conductors such as copper, magnesium and their alloys may also be suitable. As an alternative to extrusion, conductive member 510 may be formed by drawing, casting, molding or machining processes. Because cable guide 530 is fabricated as an opening within conductive bar 510, the wall of the opening is conductive and may function as the shield of an insulated wire or cable placed within the opening. Such a wire or cable could advantageously be made from a commercial coaxial cable with the outer insulation and shield removed.

In some cases, transmission line structure 500 (and similar embodiments described in U.S. Pat. No. 6,677,912) may be preferred over transmission line structure 400. For example, transmission line structure 500 includes a convex upper surface that follows the shape of opening 530 at the top of conductive bar 510 and has a width, which is only slightly greater than the diameter of the opening. As such, conductive bar 510 presents a relatively small footprint and circumference. This reduces the capacitance of a balanced transmission line formed with a pair of the conductive members, and in turn, helps to maintain a higher characteristic impedance of the transmission line.

Figure 5B:
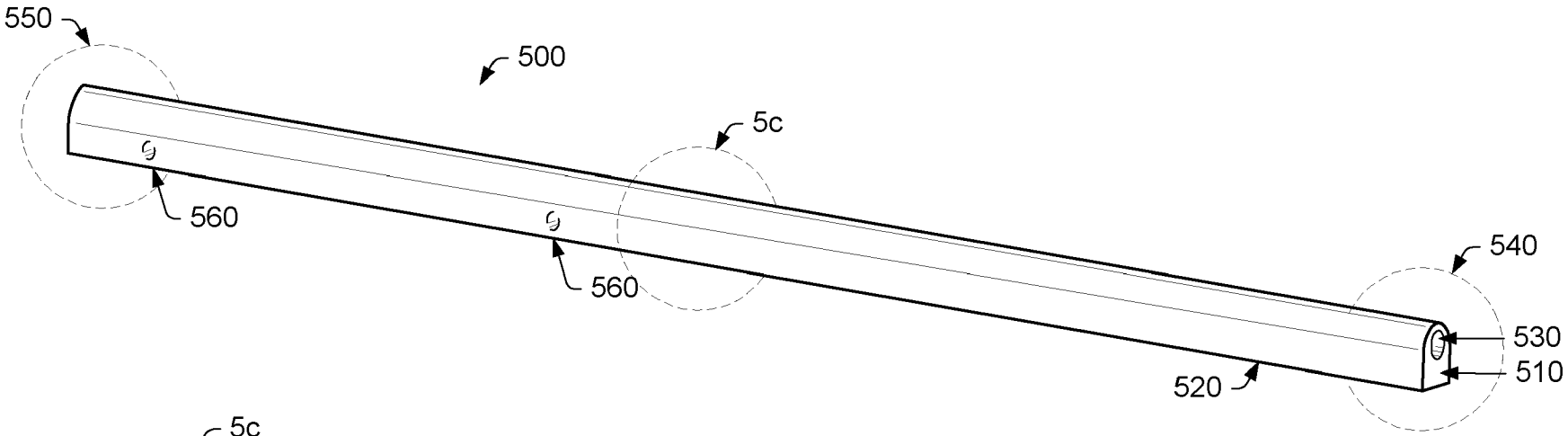
FIG. 5B is a perspective view of a transmission line structure similar to that shown in FIG. 5A.

An extended length of transmission line structure 500 is shown in FIG. 5B. In some cases, transmission line structure 500 may include one or more holes 560, which have been drilled or otherwise formed within sidewall surfaces of the transmission line structure. As described in more detail below, the optional holes 560 may be placed in a log-periodic fashion near the back end 550 of the transmission line structure 500 when dissimilar dipole elements are attached to the same transmission line structure (see, FIGS. 10-11). In other cases, transmission line structure 500 may be completely void of holes 560. For example, holes 560 may not be used in the embodiments, which attach integrated antenna elements (e.g., antenna elements 200 of FIG. 2 or 800 of FIG. 8) to the transmission line structures, as shown in FIGS. 3, 6A, 7A and 9.

Figure 5C:
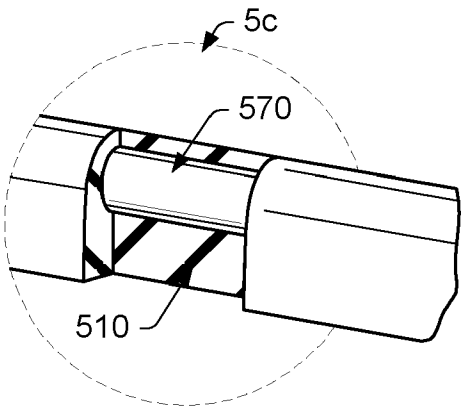
FIG. 5C is a cut-away view of the transmission line structure within region 5*c* of FIG. 5B.

A cut away view of transmission line structure 500 within region 5*c* is shown in FIG. 5C. As shown in FIG. 5C, an insulated wire 570 is arranged within opening 530 of conductive bar 510. In one embodiment, insulated wire 570 may be a commercially-available coaxial cable with its outer insulation and shield removed, such that the outer surface of insulated wire 570 is an insulating surface. In such an embodiment, the inner surface of opening 530 in conductive member 510 forms an outer shield around insulated wire 570. Of course, an insulated wire could be formed in ways, other than by modification of commercially-available coaxial cable, although such modification may be convenient in some cases.

Figure 6A:
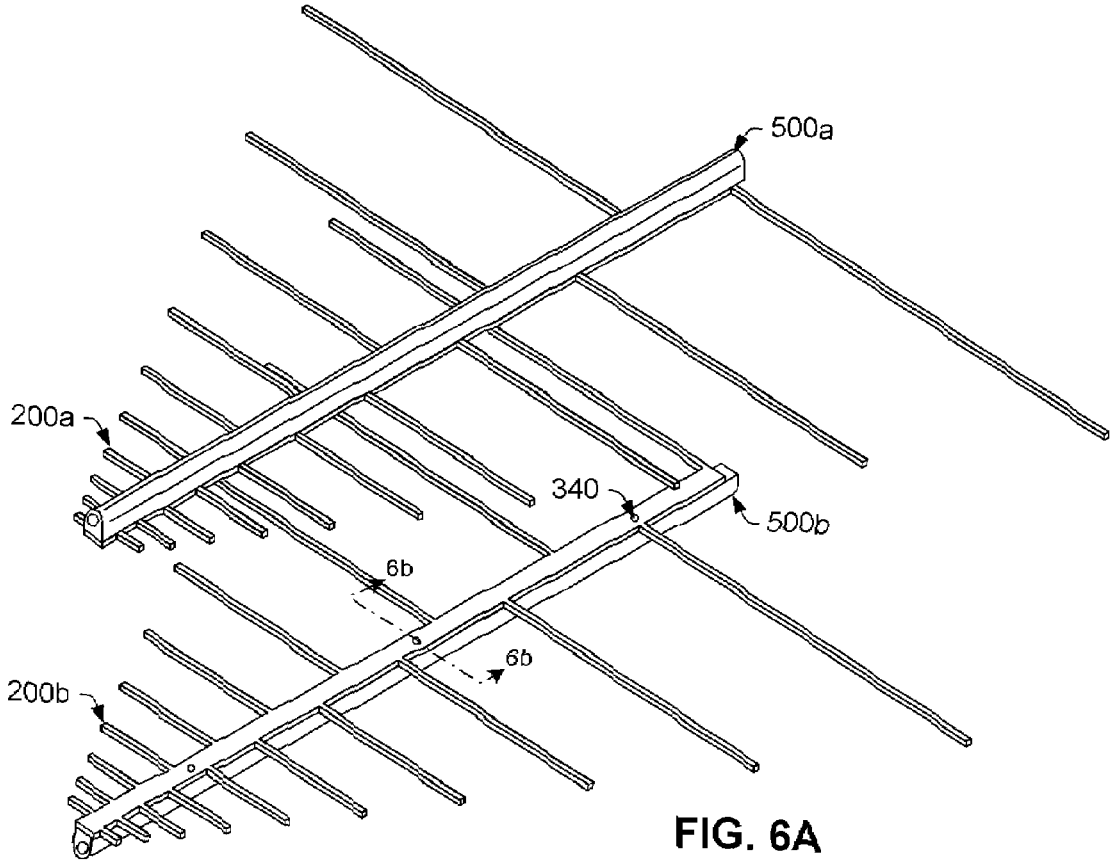
FIG. 6A is a perspective exploded view showing the antenna elements of FIG. 2 attached to the transmission line structures of FIG. 5.

FIG. 6A is an exploded view illustrating a pair of antenna elements (200*a* and 200*b*) attached to a pair of transmission line structures (500*a* and 500*b*), which have been fabricated as described above in reference to FIG. 5. As indicated above, the flat bottom surfaces (520) of the transmission line structures (500*a* and 500*b*) may be permanently attached to the center conductors (220) of the antenna elements (200*a* and 200*b*) using a variety of techniques including, but not limited to, soldering, welding, brazing and the use of a conductive epoxy. In some cases, a brazing process may be preferred, due to its ability to produce strong, continuous metallurgical bonds without warping or distorting the brazed antenna components. In other cases, a conductive epoxy may be preferred to simplify the attachment process. Either process may be used to permanently attach the antenna elements to the transmission line structures, such that a continuous electrical connection exists between the flat bottom surfaces (520) and the center conductors (220) along an entire length of the center conductors. In addition to lowering a resistance between the two parts, the preferred attachment processes described above eliminate the possibility for oxidation, and thus, reduce/eliminate the electrical contact problems associated therewith.

Figure 6B:
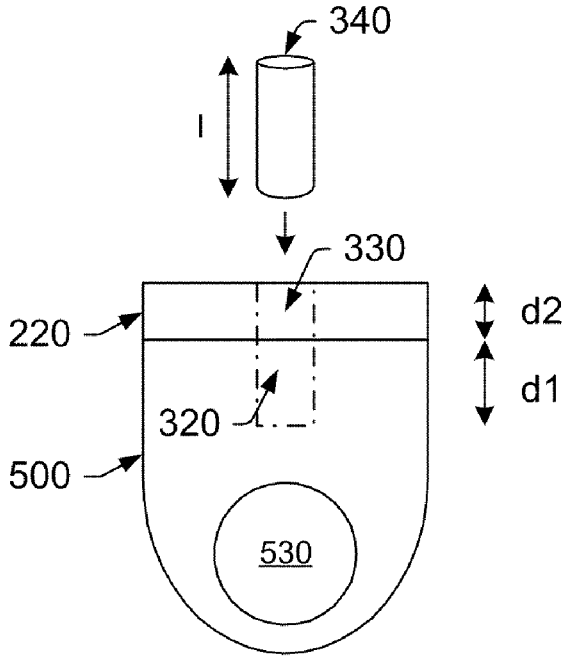
FIG. 6B is a cross-sectional view through line 6*b* of FIG. 6A showing one manner in which an antenna element may be precisely aligned to its transmission line structure.

In some cases, means may be provided for precisely aligning the antenna elements to their respective transmission line structure prior to attachment. One embodiment of such alignment means is illustrated in FIGS. 3 and 6B. For example, FIG. 3 shows one or more holes 320 formed within the flat bottom surfaces 310 of the transmission line structures. These holes 320 may be aligned with one or more holes 330 formed through the center conductors 220 of the antenna elements. As noted above, the holes may be formed using a variety of processes (including, but not limited to, a water/abrasive jet cutting process, a laser cuffing process, a plasma cutting process or a machining process), which may be similar to (or different than) the process used to form the antenna elements.

As shown in FIGS. 3 and 6B, the antenna elements may be precisely aligned to their respective transmission line structure by inserting fixturing pins 340 within the alignment holes 320, 330. In general, the fixturing pins may be inserted before the antenna elements are permanently attached to their respective transmission line structure, so that the pins may align the parts during the attachment process. In addition to ensuring precise alignment, the fixturing pins may provide an additional amount of mechanical stability to the antenna structure. Although steel or aluminum alloys are generally preferred, the fixturing pins may be formed from substantially any electrically conductive solid material.

FIGS. 6A and 6B illustrate the above-mentioned alignment means in more detail. For example, FIG. 6B is a cross-sectional view through line 6*b* of FIG. 6A illustrating how fixturing pins 340 may be inserted within alignment holes 320, 330. In most cases, alignment holes 320 may extend through only a portion of the transmission line structure. For example, alignment holes 320 may be formed so as to extend from the flat bottom surface (520) of transmission line structure (500) to a first depth (d1). In most cases, it may be preferred that the alignment holes 320 do not breech or come in contact with the openings (530) formed within the transmission line structure (500). This may prevent the fixturing pins from obstructing the pathway in which the coaxial feed line will be subsequently fed.

In some cases, alignment holes 330 may extend through an entire depth (d2) of the antenna elements, as shown in FIG. 6B. This would allow fixturing pins 340 to be inserted through the antenna elements and into the transmission line structure. In most cases, a length (1) of the fixturing pins may be selected to provide a flush surface, once the fixturing pins are inserted into the alignment holes, as shown in FIG. 6B. In other words, the length (1) of the fixturing pins may be substantially equal to d1+d2. In other cases, alignment holes 330 may extend through only a portion of the antenna elements (not shown). This would require fixturing pins 340 to be inserted between the antenna elements and respective transmission line structures.

In some cases, alignment means other than those specifically shown herein may be used to align the antenna elements to their respective transmission line structures. However, alignment means may not always be necessary or desired. If used, such means may provide precision alignment between the antenna elements and transmission line structures, as well as an additional amount of mechanical stability to the two substantially identical structures.

Once attached, the two substantially identical structures (e.g., 200*a*/500*a* and 200*b*/500*b* of FIG. 6A) may be chemically treated, if necessary or desired. For example, if 7000 series aluminum is used to form the antenna elements and/or the transmission line structures, the antenna components may be first attached (e.g., using brazing or a conductive epoxy) and then chemically treated (possibly with an anodizing or chromate salt process) to provide a highly robust surface with a significantly reduced (or eliminated) susceptibility to oxidation.

FIG. 7A is a perspective view of a complete LPDA antenna (700), according to one embodiment of the invention. In particular, FIG. 7A illustrates one manner in which the two substantially identical structures (e.g., 200*a*/500*a* and 200*b*/500*b* of FIG. 6A) may be coupled together and arranged within two spaced-apart, parallel planes. For example, it is necessary to separate the transmission line structures (500*a*, 500*b*) to maintain the structure of a two-conductor uniform line. In a general embodiment, one or more dielectric spacers may be used to maintain the two substantially identical structures in the desired configuration. In the embodiment of FIG. 7A, three dielectric spacers (e.g., 710 of FIG. 7A, 750 of FIG. 7B) are used to maintain a relatively consistent spacing between transmission line structures 500*a* and 500*b*.

However, a substantially different number of dielectric spacers (e.g., about 1 to about 5) may be used to maintain a relatively consistent spacing between transmission line structures 500*a* and 500*b*, in other embodiments of the invention. Because the dielectric spacers have a detrimental effect on the antenna radiation pattern, it is usually best to use as few as possible. In some cases, the spacing between transmission line structures may sometimes vary along a length of the structures. For example, the antenna may in some cases be formed in a "V" shape, with a slightly larger spacing between structures 500*a* and 500*b* at the back end 550. This approach may be used to reduce spurious longitudinal modes and is discussed further in the previous patent. In some cases, means other than dielectric spacers 710 and 750 may be used for maintaining the two substantially identical structures (200*a*/500*a* and 200*b*/500*b*) in the desired configuration.

As indicated above, a coaxial cable may be threaded through opening 530 of conductive member 510 for feeding the LPDA antenna. In most cases, the feed signal is connected near the back end 550 of conductive member 510 using a coaxial connector (not shown). In some cases, the outer shield of the coaxial connector may be connected to transmission line structure 500*b*, so that transmission line structure 500*b* is at ground potential. The inner conductor of the coaxial connector may be connected to the inner conductor of the insulated wire or cable carried within transmission line structure 500*b*. The inner conductor of the insulated wire or cable may then be connected to transmission line structure 500*a*, as shown in FIG. 7B.

FIG. 7B is a perspective view, within region 7*b* of FIG. 7A, of the front end of LPDA antenna 700. More specifically, FIG. 7B is an expanded view of region 7*b* of FIG. 7A with insulating cap 720 removed. As shown in FIG. 7B, conductive bridge 730 connects the inner conductor of the insulated wire or cable to conductive member 510 of transmission line structure 500*a*. In some cases, the inner conductor of the insulated wire or cable may be soldered to bridge 730 at point 740. Insulating spacer 750 isolates the outside of transmission line structure 500*b* from the feed voltage on bridge 730 and transmission line structure 500*a*.

FIGS. 8-9 illustrate another embodiment of an improved LPDA antenna (900), in accordance with the present invention. In particular, FIG. 8 is a perspective view of an antenna element (800*a*), according to one alternative embodiment of the invention. Like the previous embodiment shown in FIG. 2, antenna element 800*a* includes a plurality of dipole elements (810*a*), which extend outward from a center conductor (820*a*)

in a log-periodic fashion. A substantially identical antenna element (800*b*, not shown) may be fabricated in the same manner, albeit a mirror image, of antenna element 800*a*.

Unlike the previous embodiment, however, the width (W1, W2, W3, etc.) of the dipole elements (810*a*) are scaled along a length (L) of the center conductor (820*a*). In some cases, such scaling may be used to provide a better approximation to an idealized antenna, in which the diameter-to-length ratio for each dipole element is roughly the same. In some cases, the thickness of the dipole elements may be scaled in addition to, or instead of, the width. For example, the antenna elements may be cut from two or more sheets of conductive material having different thicknesses, as described above. Scaling both the thickness and the width of the dipole elements is thought to provide the closest approximation to an idealized antenna. However, cutting the antenna elements from different material thicknesses may require additional assembly steps, and thus, may not be desired in all embodiments of the invention.

FIG. 9 is a perspective view of a complete LPDA antenna (900), according to another embodiment of the invention. In most cases, the front end (9*b*, FIG. 9) of the antenna may be configured similar to that described above in reference to FIG. 7B. Like FIG. 7A, FIG. 9 illustrates one manner in which the two substantially identical structures (800*a*/500*a* and 800*b*/500*b*) may be coupled together and arranged within two spaced-apart, parallel planes. For example, FIG. 9 illustrates that two dielectric spacers (e.g., 910 of FIG. 9 and 750 of FIG. 7B) may be used to maintain a relatively consistent spacing between transmission line structures 500*a* and 500*b*. As noted above, however, substantially any number of dielectric spacers (or other means of spacing) may be used in other embodiments of the invention. The LPDA antenna (900) shown in FIG. 9 may also be fed as described above in reference to FIG. 7B.

In some cases, the LPDA antennas (700, 900) shown in FIGS. 7A and 9 may be combined with a traditional LPDA design employing dipole elements attached with screws. The combination may be used to produce a hybrid LPDA antenna capable of operating over a significantly broad frequency range (e.g., about 80 MHz to about 6000 MHz). The approach may also provide an antenna design, which may be partially disassembled (if desired) to provide a great reduction in size, while maintaining the advantages described above. Exemplary embodiments of such an approach are illustrated in FIGS. 10 and 11.

Figure 10:
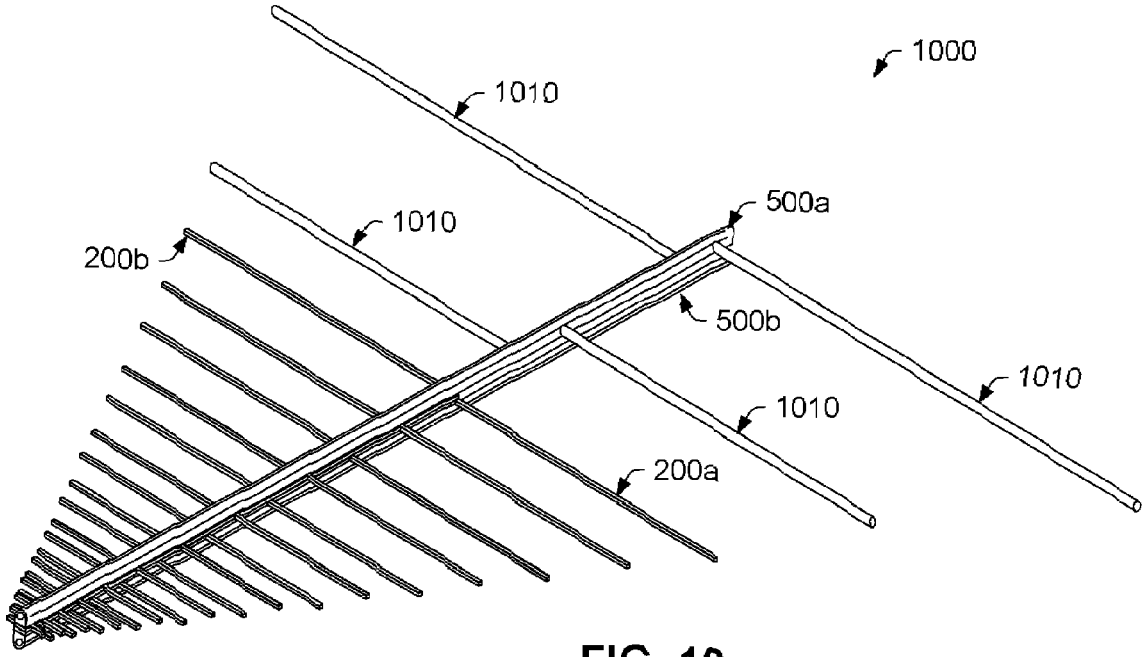
FIG. 10 is a perspective view of one embodiment of a hybrid LPDA antenna including a high frequency portion similar to the LPDA antenna of FIG. 7A and a low frequency portion comprising a plurality of dipoles coupled to a transmission line structure with mechanical fasteners.

FIG. 10 illustrates one embodiment of a hybrid LPDA antenna (1000) including a high frequency portion and a low frequency portion. In the embodiment of FIG. 10, the high frequency portion is implemented with the antenna elements (200*a*, 200*b*) shown in FIG. 2. The low frequency portion is implemented with one or more pairs of dipole elements (1010) fabricated, for example, from cylindrical bar stock (although bar stock having alternative cross-sectional shapes may be used).

In most cases, the integrated antenna elements (200*a*, 200*b*) and individual dipole elements (1010) are coupled to a single pair of transmission line structures (500*a*, 500*b*), as shown in FIG. 10. For example, the integrated antenna elements (200*a*, 200*b*) and dipole elements (1010) may be coupled to a transmission line structure having holes (560), as shown in FIG. 5B. The integrated antenna elements (200*a*, 200*b*) may be brazed or epoxied to a flat bottom surface (520) of the transmission line structure (500) near the front end (540), as described above. One dipole element within each dipole pair may then be coupled to the transmission line structure (500) near the back end (550). For example, screws (not shown) may be threaded through holes (560) for attaching the dipole elements to the transmission line structure. However, one skilled in the art would understand how alternative means could be used to attach the individual dipole elements (1010) to the back end (550) of the transmission line structures.

Figure 11:
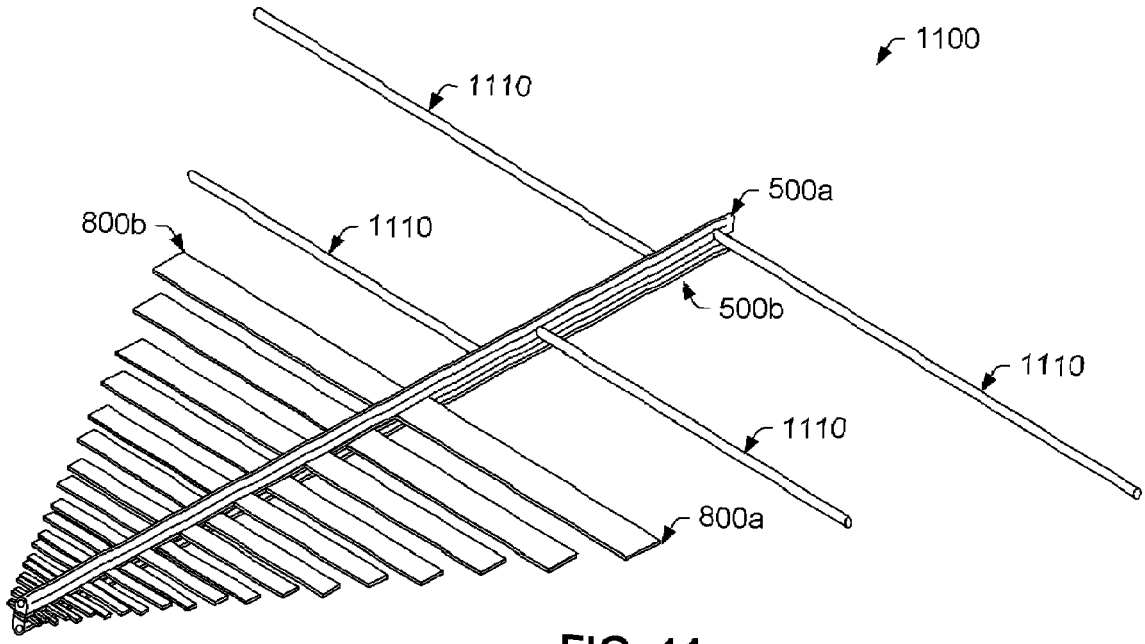
FIG. 11 is a perspective view of another embodiment of a hybrid LPDA antenna including a high frequency portion similar to the LPDA antenna of FIG. 9 and a low frequency portion comprising a plurality of dipoles coupled to a transmission line structure with mechanical fasteners.

FIG. 11 illustrates another embodiment of a hybrid LPDA antenna (1100) including a high frequency portion and a low frequency portion. In the embodiment of FIG. 11, the high frequency portion is implemented with the antenna elements (800*a*, 800*b*) shown in FIG. 9. The low frequency portion is implemented with one or more pairs of dipole elements (1110) fabricated, for example, from cylindrical bar stock (although bar stock having alternative cross-sectional shapes may be used).

In most cases, the integrated antenna elements (800*a*, 800*b*) and dipole elements (1110) may be coupled to a single pair of transmission line structures (500*a*, 500*b*), as shown in FIG. 11. For example, the integrated antenna elements (800*a*, 800*b*) and dipole elements (1110) may be coupled to a transmission line structure having holes (560), as shown in FIG. 5B. The integrated antenna elements (800*a*, 800*b*) may be brazed or epoxied to a flat bottom surface (520) of the transmission line structure (500) near the front end (540), as described above. One dipole element (1110) within each dipole pair may then be coupled to the transmission line structure (500) near the back end (550). For example, screws (not shown) may be threaded through holes (560) for attaching the dipole elements to the transmission line structure. However, one skilled in the art would understand how alternative means could be used to attach the individual dipole elements (1110) to the back end (550) of the transmission line structures.

It will be appreciated to those skilled in the art having the benefit of this disclosure that this invention is believed to provide an improved LPDA antenna and method of making. Further modifications and alternative embodiments of various aspects of the invention will be apparent to those skilled in the art in view of this description. It is intended, therefore, that the following claims be interpreted to embrace all such modifications and changes and, accordingly, the specification and drawings are to be regarded in an illustrative rather than a restrictive sense.

What is claimed is:

1. A log periodic dipole array (LPDA) antenna comprising:

a first antenna element fabricated as a continuous piece of conductive material to include a plurality of dipole elements extending outward from a center conductor;

a second antenna element fabricated in the same manner, albeit a mirror image, of the first antenna element; and a pair of transmission line structures, each coupled to a different center conductor of the first and second antenna elements, such that no electrical discontinuities exist between the antenna elements and its respective transmission line structure.

2. The LPDA antenna recited in claim 1, wherein the first and second antenna elements are not formed on or within a dielectric substrate.

3. The LPDA antenna recited in claim 1, wherein each of the first and second antenna elements is fabricated from a single sheet of metal.

4. The LPDA antenna recited in claim 3, wherein the single sheet of metal is selected from a group of metals comprising aluminum, copper, magnesium, brass and alloys thereof.

5. The LPDA antenna recited in claim 4, wherein the contour is cut from the sheet of metal using a high pressure water jet tool, a high pressure abrasive jet tool, a laser cutting tool, a plasma cutting tool or a machining tool.

6. The LPDA antenna recited in claim 1, wherein each of the first and second antenna elements is fabricated from a single sheet of metal by cutting a contour of the plurality of dipole elements and the center conductor from the sheet of metal.

7. The LPDA antenna recited in claim 1, wherein each of the transmission line structures comprises a conductive member having a flat bottom surface.

8. The LPDA antenna recited in claim 7, wherein each of the conductive members is fabricated from a metal or metal alloy using an extrusion, casting, molding or machining process.

9. The LPDA antenna recited in claim 7, wherein at least one of the transmission line structures comprises:

a cable guide or opening formed within a respective conductive member and extending along a length of the respective conductive member; and a coaxial feed line arranged within the cable guide or opening for feeding the LPDA antenna.

10. The LPDA antenna recited in claim 7, wherein the first and second antenna elements are coupled to the pair of transmission line structures by permanently attaching the flat bottom surface of each conductive member to a respective center conductor of the first and second antenna elements, such that a continuous electrical and thermal connection exists between the flat bottom surfaces and the center conductors along an entire length of the center conductors.

11. The LPDA antenna recited in claim 10, wherein the flat bottom surfaces of the conductive members are permanently attached to the center conductors of the first and second antenna elements using a brazing process.

12. The LPDA antenna recited in claim 10, wherein a conductive epoxy is used to permanently attach the flat bottom surfaces of the conductive members to the center conductors of the first and second antenna elements.

13. The LPDA antenna recited in claim 10, wherein two substantially identical structures are formed by coupling the first and second antenna elements to the pair of transmission line structures, and wherein the two substantially identical structures are coupled together by one or more dielectric spacers configured to maintain the two identical structures within two spaced-apart, parallel planes.

14. A log periodic dipole array (LPDA) antenna comprising:

a high frequency portion comprising:

a pair of antenna elements, each fabricated as a continuous piece of conductive material to include a first plurality of dipole elements extending outward from a center conductor in a log-periodic fashion; and a pair of transmission line structures, each permanently affixed to a different center conductor of the antenna elements, such that no electrical discontinuities exist between the antenna elements and their respective transmission line structure along an entire length of the center conductors; and a low frequency portion comprising a second plurality of dipole elements extending outward from the pair of transmission line structures in a log-periodic fashion.

15. The LPDA antenna recited in claim 14, wherein each of the transmission line structures comprises a conductive member having a flat bottom surface.

16. The LPDA antenna recited in claim 15, wherein a brazing process is used to permanently attach the center conductors of the antenna elements to the flat bottom surfaces of the conductive members near a front end of transmission line structures.

17. The LPDA antenna recited in claim 15, wherein a conductive epoxy is used to permanently attach the center conductors of the antenna elements to the flat bottom surfaces of the conductive members near a front end of transmission line structures.

18. The LPDA antenna recited in claim 15, wherein each of the conductive members is fabricated from a metal or metal alloy using an extrusion, casting, molding or machining process.

19. The LPDA antenna recited in claim 15, wherein at least one transmission line structure within the pair of transmission line structures comprises:

a cable guide or opening formed within a respective conductive member and extending along a length of the respective conductive member; and a coaxial feed line arranged within the cable guide or opening for feeding the LPDA antenna.

20. A method for forming a log periodic dipole array (LPDA) antenna, the method comprising:

fabricating a pair of antenna elements, each comprising a plurality of dipole elements extending outward from a center conductor in a log-periodic fashion, by cutting a contour of the plurality of dipole elements and the center conductor from a sheet of metal;

fabricating a pair of transmission line structures, each comprising a conductive member with a flat bottom surface, wherein at least one of the conductive members comprises a coaxial feed line arranged within an opening that extends along a length of the conductive member; and coupling each of the antenna elements to a respective one of the transmission line structures by permanently attaching the flat bottom surface of each conductive member to a respective center conductor of the antenna elements, such that a continuous electrical connection exists between the flat bottom surfaces and the center conductors along an entire length of the center conductors.

21. The method as recited in claim 20, wherein the step of fabricating the pair of antenna elements comprises cutting the contours from the sheet of metal using a high pressure water/abrasive jet tool, a laser cutting tool, a plasma cutting tool or a machining tool.

22. The method as recited in claim 21, wherein the sheet of metal is selected from a group of metals comprising aluminum, copper, magnesium, brass and alloys thereof.

23. The method as recited in claim 20, wherein the step of fabricating the pair of transmission line structures comprises fabricating each of the conductive members from a metal or metal alloy using an extrusion, casting, molding or machining process.

24. The method as recited in claim 20, wherein the step of coupling comprises permanently attaching the flat bottom surface of each conductive member to a respective center conductor of the antenna elements using a brazing process.

25. The method as recited in claim 20, wherein the step of coupling comprises permanently attaching the flat bottom surface of each conductive member to a respective center conductor of the antenna elements using a conductive epoxy.

26. The method as recited in claim 20, wherein prior to the step of coupling, the method comprises:

forming one or more holes within the pair of antenna elements, which are in alignment with one or more holes formed within the pair of transmission line structures; and inserting fixturing pins within the holes formed within each antenna element and its respective transmission line structure, such that a top surface of each pin is flush with a surface of the antenna elements.

27. The method as recited in claim 20, wherein the steps of fabricating the pair of antenna elements, fabricating the pair of transmission line structures and coupling form two substantially identical structures, and wherein the method further comprises coupling the two substantially identical structures together, so as to maintain the two substantially identical structures within two spaced-apart, parallel planes.

* * * * *